US007679013B2

(12) United States Patent
Kobayashi et al.

(10) Patent No.: US 7,679,013 B2
(45) Date of Patent: Mar. 16, 2010

(54) ELECTRONIC DEVICE

(75) Inventors: Shinji Kobayashi, Tokai (JP); Keiji Seo, Nagoya (JP); Akira Sago, Seto (JP); Atsushi Kasugai, Nagoya (JP); Hiroaki Kita, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 343 days.

(21) Appl. No.: 11/904,441

(22) Filed: Sep. 27, 2007

(65) Prior Publication Data

US 2008/0291038 A1 Nov. 27, 2008

(30) Foreign Application Priority Data

Oct. 13, 2006 (JP) ..... 2006-279422

(51) Int. Cl.
*H01H 3/16* (2006.01)

(52) U.S. Cl. ..... 200/50.02; 200/61.7

(58) Field of Classification Search ..... 200/61.62, 200/61.7, 333, 334, 518; 353/119
See application file for complete search history.

(56) References Cited

U.S. PATENT DOCUMENTS 7,141,750 B2 * 11/2006 Yamada ..... 200/341
7,329,820 B2 * 2/2008 Yamamoto ..... 200/61.62

FOREIGN PATENT DOCUMENTS

JP 5 262011 10/1993

* cited by examiner

*Primary Examiner*—Renee S Luebke
*Assistant Examiner*—Lisa Klaus
(74) *Attorney, Agent, or Firm*—Day Pitney LLP

(57) ABSTRACT

There is provided an electronic device that enables and ensures the detection of the open/close condition and attached condition of a plurality of cover bodies by only one detection switch. Therefore, an electronic device comprises an upper cover, a front cover, an actuator, and a mechanical switch. The upper cover is provided openable and closable with respect to a rolled sheet holder storing case, and the front cover is removably attached on the rolled sheet holder storing case for covering a component, which is housed in the rolled sheet holder storing case. The actuator is provided on the front cover, and it makes an action when the upper cover is closed to the rolled sheet holder storing case, and the mechanical switch detects the action of the actuator. This arrangement forms a system that detects sequentially the action taken for closing the upper cover to the rolled sheet holder storing case, by relaying the action via the actuator, which is provided on the front cover, to the mechanical switch, which detects the action.

8 Claims, 12 Drawing Sheets

ELECTRONIC DEVICE

CROSS-REFERENCE TO RELATED APPLICATIONS

The present application claims priority from JP 2006-279422, filed on Oct. 13, 2006, the disclosure of which is herein incorporated by reference in its entirety.

TECHNICAL FIELD

The disclosure relates to an electronic device and, in particular, to an open/close detection of a cover body provided for an electronic device.

BACKGROUND

It has been customary, in an electronic device comprising a main body housing provided with a cover body, for operating the electronic device in good condition and for maintaining security, that the electronic device be designed to make certain actions after the cover body is fully closed or attached. For this reason, there have been presented various technologies for detecting the opened or closed condition or the attached condition of a cover body provided for an electronic device.

As such a technology, for example, Japanese Patent Application Laid-Open No. H5(1993)-262011 discloses a cover-open switch that comprises a detection switch as means for detecting the opened or closed condition of a printer cover, the detection switch being provided on the main board of the printer. For the actuation of the switch, part of the upper plate of a cabinet of the printer is formed into a lever-like part having resiliency, and the leading end of the lever-like part is positioned facing directly the detection switch. In addition, a protrusion is provided on the back of the printer cover so that the protrusion pushes the lever-like part when the printer cover is closed.

The arrangement disclosed in Japanese Patent Application Laid-Open No. 5-262011, which is described above, is an effective technology for the open/close detection of only one cover body. However, for a case where an electronic device is provided with a plurality of cover bodies, this technology has a problem that one detection switch must be provided for each of the cover bodies to achieve the open/close detection of all the cover bodies. This also presents other related problems such as increased number of manufacturing processes and increased costs. Conventionally,

SUMMARY

Accordingly, the disclosure has been accomplished to solve the above-described problem and an object of the disclosure is to provide an electronic device that enables and ensures the detection of the open/close condition or attached condition of a plurality of cover bodies by only one detection switch while keeping the electronic device simple in construction.

To achieve the purpose of the disclosure, there is provided an electronic device comprising: a first cover body, which constitutes a housing for the device and houses a component inside; a second cover body, which is provided openable and closable with respect to the first cover body; a third cover body, which is provided removably to the first cover body, for covering the component housed in the first cover body; an actuating member, which is provided on the third cover body and makes an action when the second cover body is closed to the first cover body; and detecting means, which detects the action of the actuating member.

The electronic device according of the disclosure comprises a second cover body, a third cover body, an actuating member, and detecting means. In the device, the second cover body is provided openable and closable with respect to the first cover body, and the third cover body is provided removably on the first cover body for covering a component, which is housed in the first cover body. The actuating member is provided to the third cover body and makes an action when the second cover body is closed to the first cover body, and the detecting means detects the action of the actuating member. This arrangement configures a system that detects sequentially the action taken for closing the second cover body to the first cover body by relaying the action via the actuating member, which is provided on the third cover body, to the detecting means, which detects the action. This system is a so-called fool-proof design. For example, if the third cover body is not attached correctly by a repairer after some repair work or if the actuating member breaks down, then the system loses its structural integrity, preventing the electronic device from operating. This system is also a cost-effective design because only one detecting means is applied for detecting the open/close and attachment of a plurality of cover bodies.

DETAILED DESCRIPTION

Figure 1:
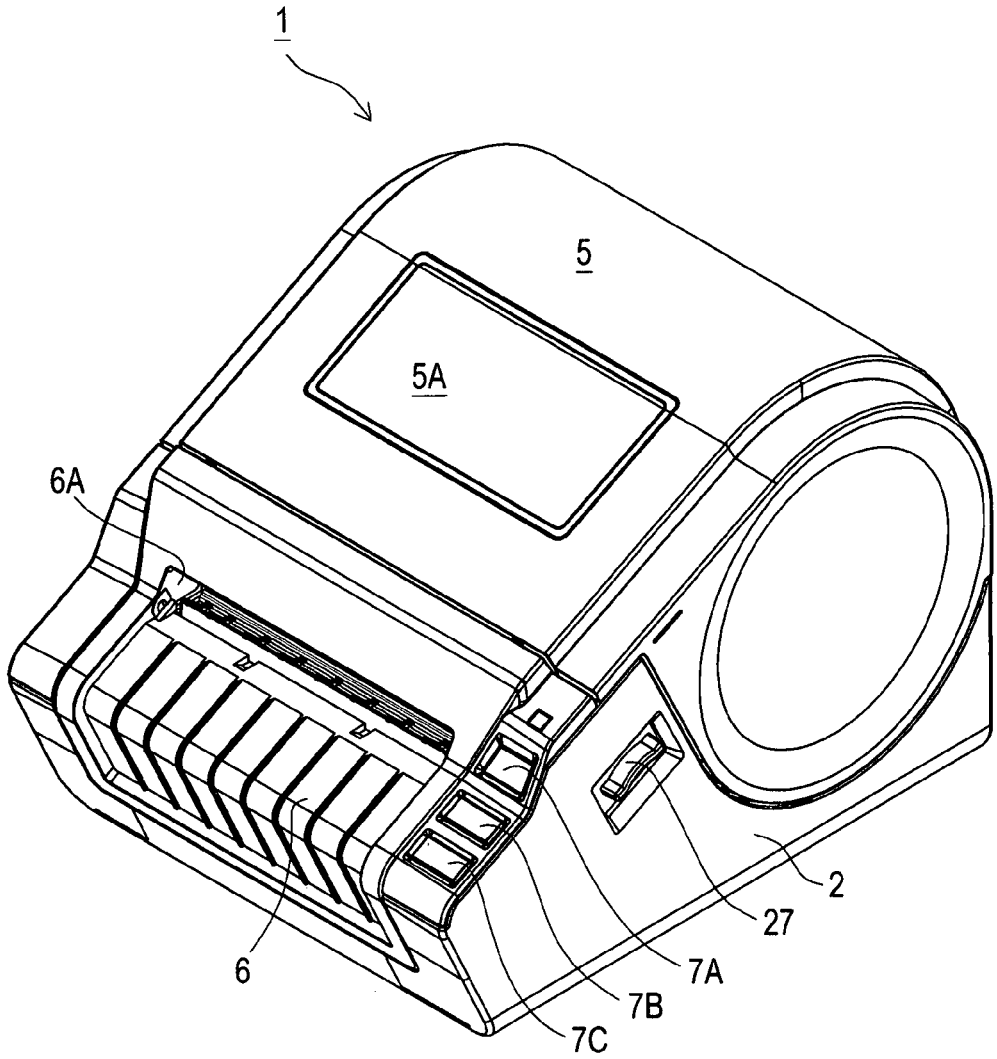
FIG. 1 is a perspective view of a tape-printing device as an embodiment, showing an outward appearance viewed from its front side.
Figure 2:
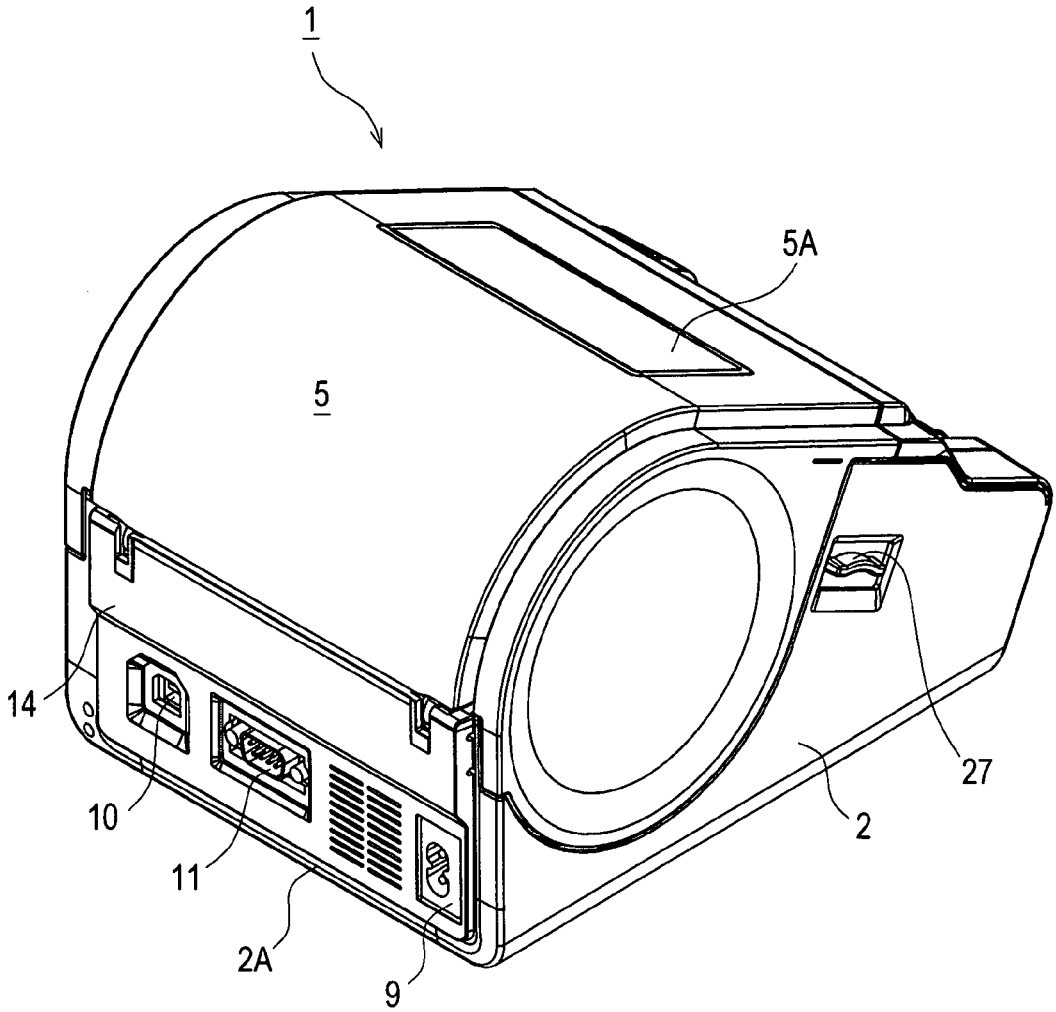
FIG. 2 is a perspective view of the tape-printing device, showing an outward appearance viewed from its rear side.

A detailed description of an exemplary embodiment of an electronic device of the disclosure will be described in detail with reference to the accompanying drawings. The electronic device according to this embodiment is a tape-printing device, whose main body is loaded with a long rolled sheet used for printing by a line-type thermal head.

Firstly, there will be described the schematic structure of the tape-printing device to which a roll sheet holder of the present embodiment is to be attached.

As shown in FIGS. 1-6, the tape-printing device 1 comprises a main body housing 2, to which a rolled sheet holder storing case 4 is attached. A rolled sheet holder storing part 4A provided in the rolled sheet holder storing case 4 receives a rolled sheet holder 3, on which a rolled sheet 3A (hereinafter referred to as the "rolled sheet 3A") with a predetermined width and an unspecified length is put around. The upper part of the rolled sheet holder 3 is covered by an upper cover 5, which is made of a plastic and is so attached to the upper-rear end of the rolled sheet holder storing case 4 via hinges 29 and 30 (refer to FIG. 9) that the upper cover 5 can be opened or closed freely. A see-through window 5A made of a transparent plastic is provided in the upper part of the upper cover 5 so that a user can see the rolled sheet 3A, which is loaded in the rolled sheet holder storing part 4A.

Furthermore, at the front end in sheet-feeding direction of the upper cover 5 (i.e., at the right-side end in FIG. 1), provided are a power button 7A, a feed button 7B, which is pushed down and kept depressed as long as necessary for feeding the rolled sheet 3A, and a cut button 7C, which is pushed down to activate a cutter unit 8 for cutting a piece off from the rolled sheet 3A. The cutter unit 8 is positioned at the lower-front part of the upper cover 5 and is covered by a front cover 6 for preventing accidents such as finger-trapping, and the front cover 6 is provided with a sheet outlet 6A, through which a printed piece separated from the rolled sheet 3A is discharged outside.

Figure 9:
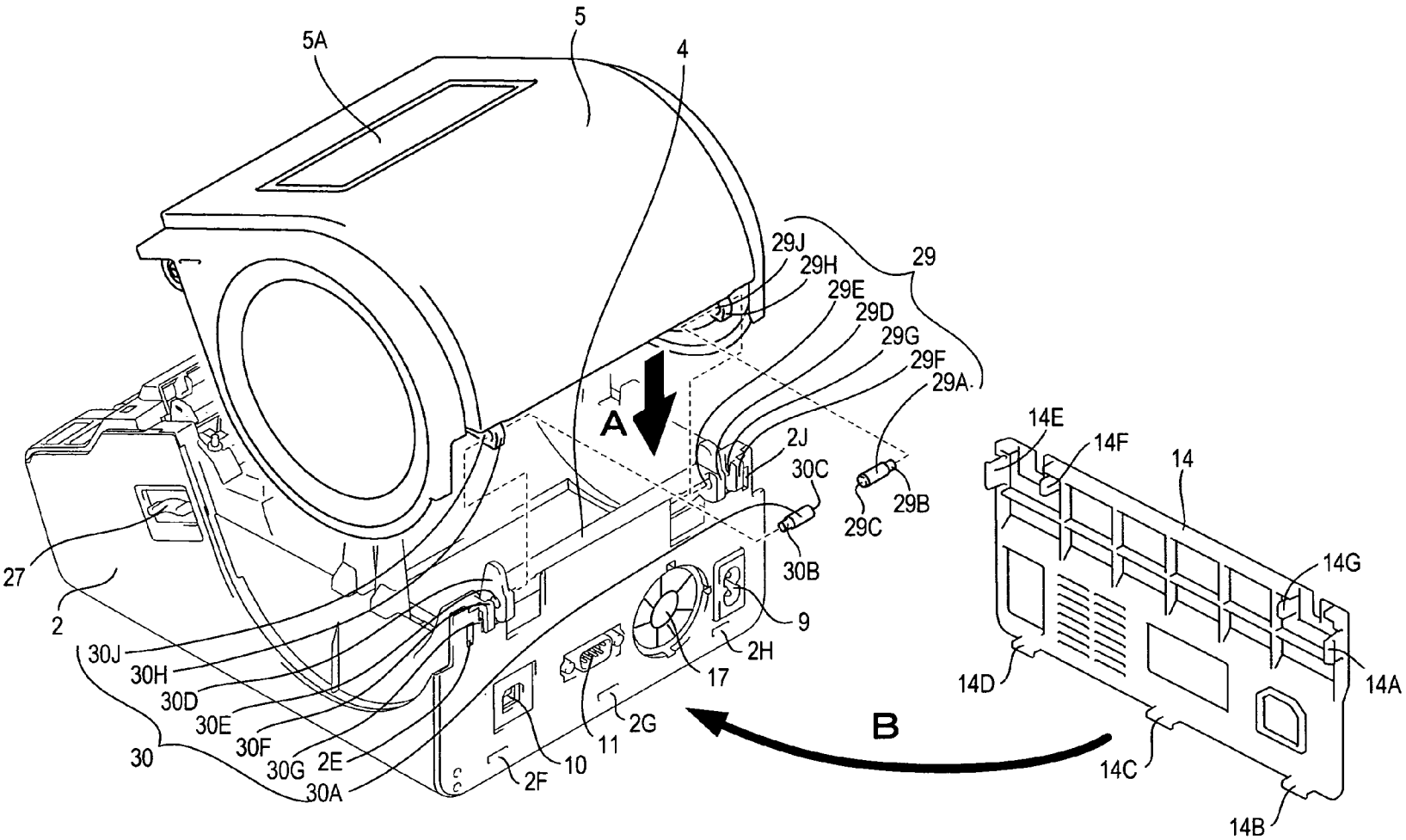
FIG. 9 is an illustration for describing a process where an upper cover is attached to a rolled sheet holder storing case.

In the rear wall 2A of the main body housing 2, a power inlet 9 is provided near a lateral end (the right-side end in FIG. 2) for receiving a power cable (not shown), and next to the power inlet 9, a fan 17 is provided as a blower (refer to FIG. 9). In addition, leftward from these elements in the rear wall, a USB (Universal Serial Bus) connector 10, which is used for connection, for example, to a personal computer (not shown), and another connector 11 are provided. Furthermore, the rear wall 2A of the main body housing 2 is provided with a rear cover 14, which is attached to cover the rear wall 2A.

Figure 5:
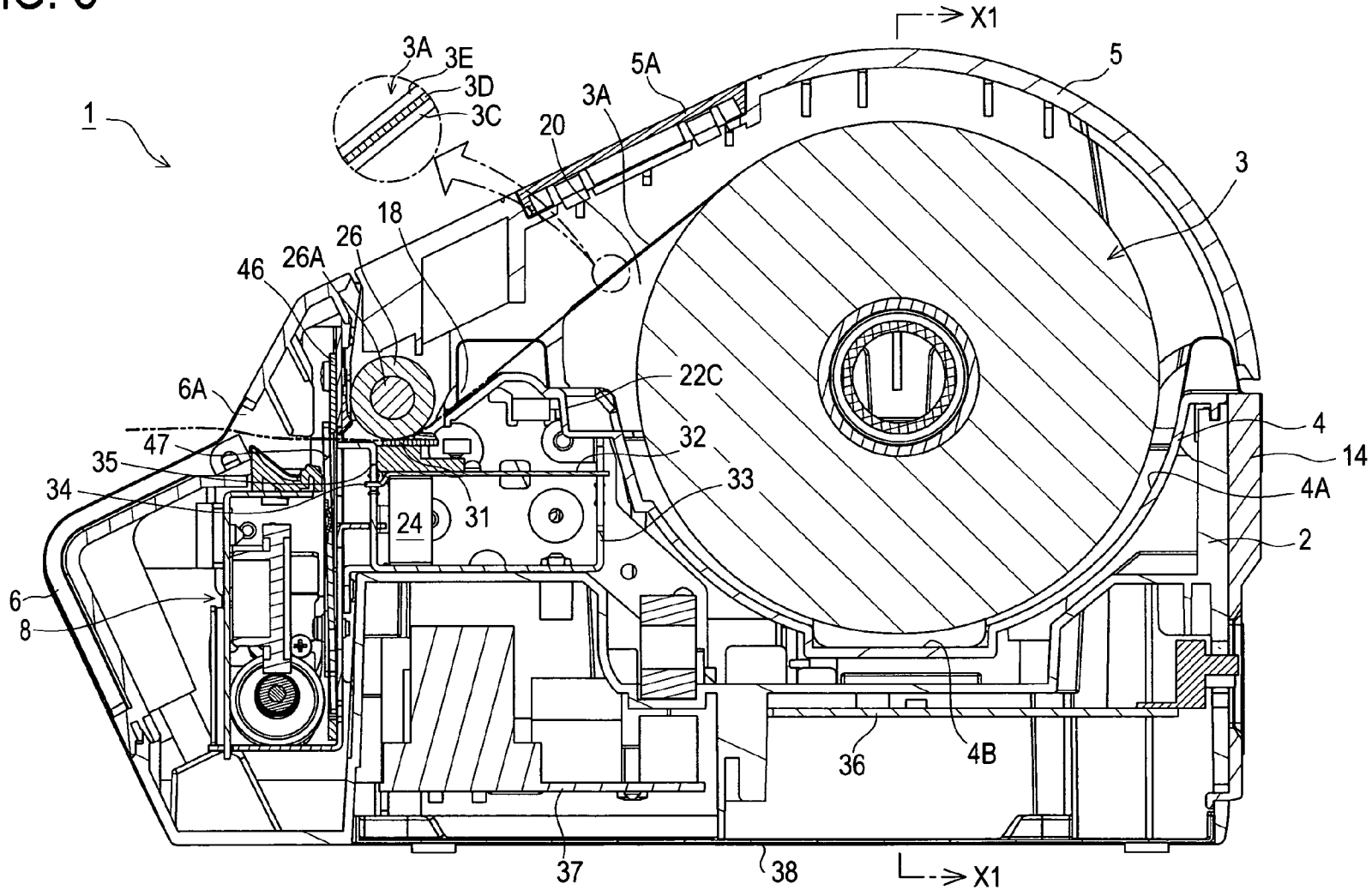
FIG. 5 is a cross-sectional side view showing the rolled sheet holder, which is set in the tape-printing device.

As shown in FIG. 5, the rolled sheet 3A comprises a long, self-coloring and heat-sensitive sheet (so-called, thermal paper) 3C and a release sheet 3E, which is applied via an adhesive layer 3D provided on the back surface of the heat-sensitive sheet 3C. The rolled sheet 3A is rolled such that the heat-sensitive sheet 3C is positioned inward in the roll.

Figure 3:
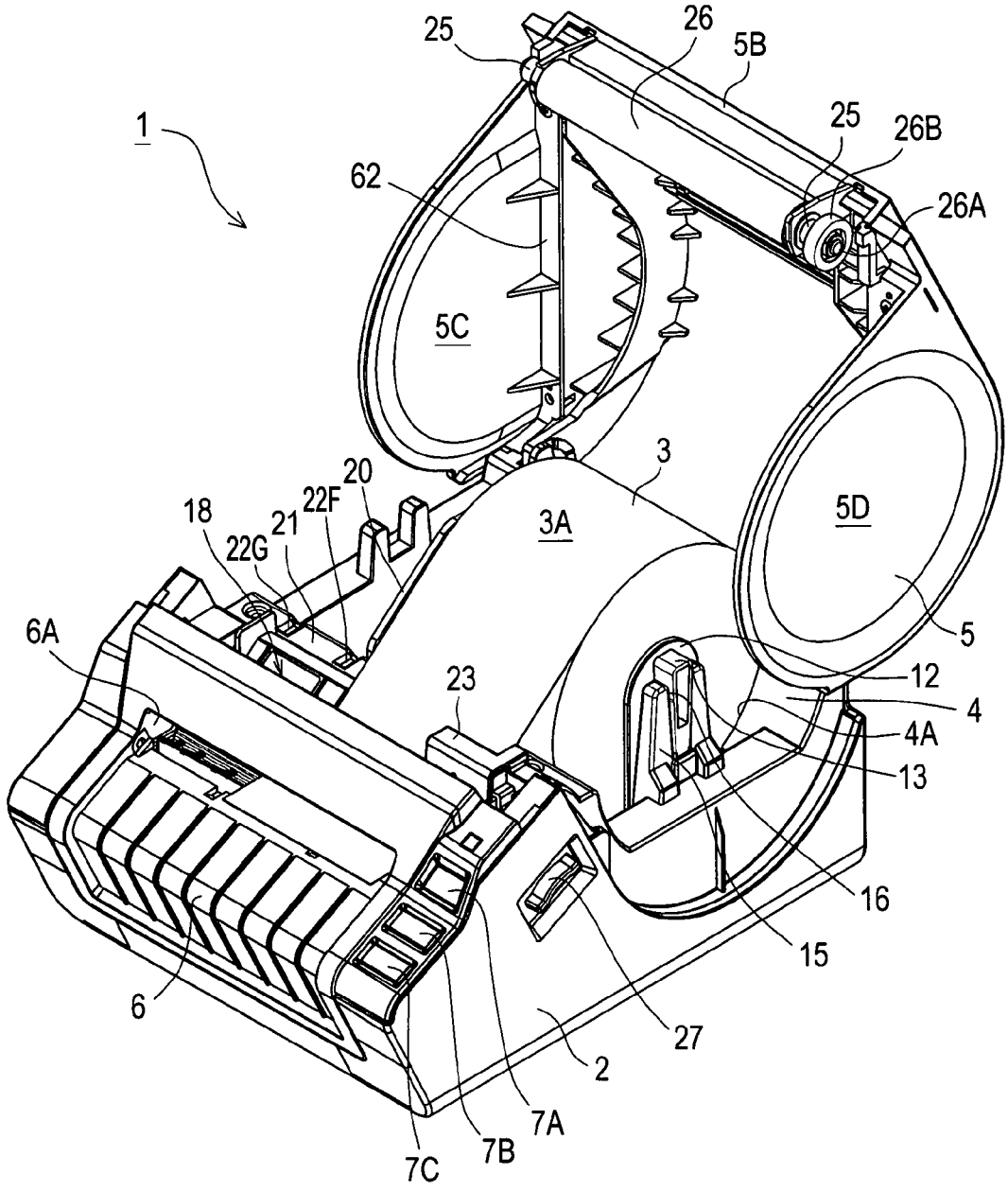
FIG. 3 is a perspective view of the tape-printing device with its upper cover being opened, viewed from its upper-right side, showing a rolled sheet holder, which is set in the device.
Figure 4:
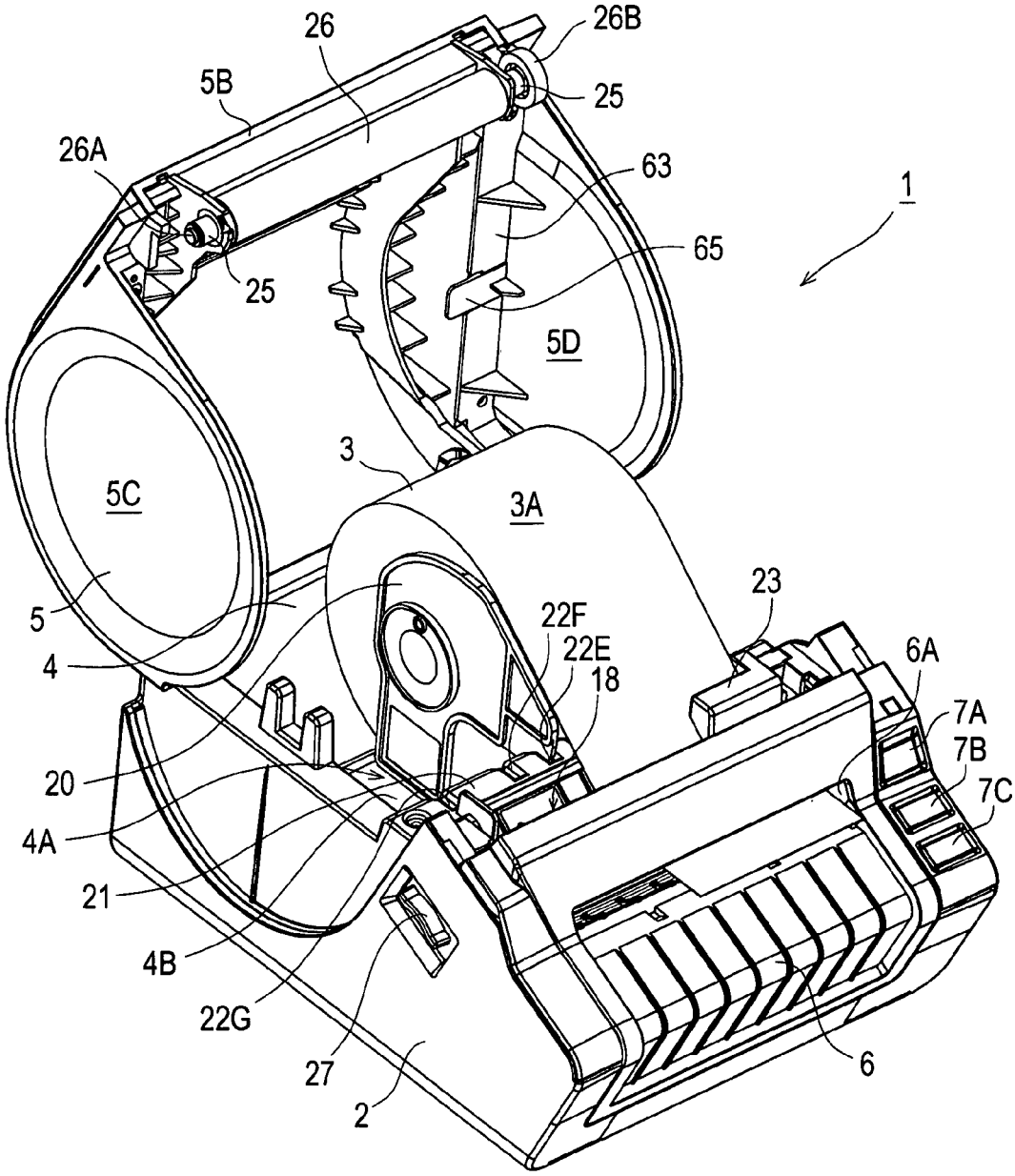
FIG. 4 is a perspective view of the tape-printing device with its upper cover being opened, viewed from its upper-left side, showing the rolled sheet holder, which is set in the device.
Figure 6:
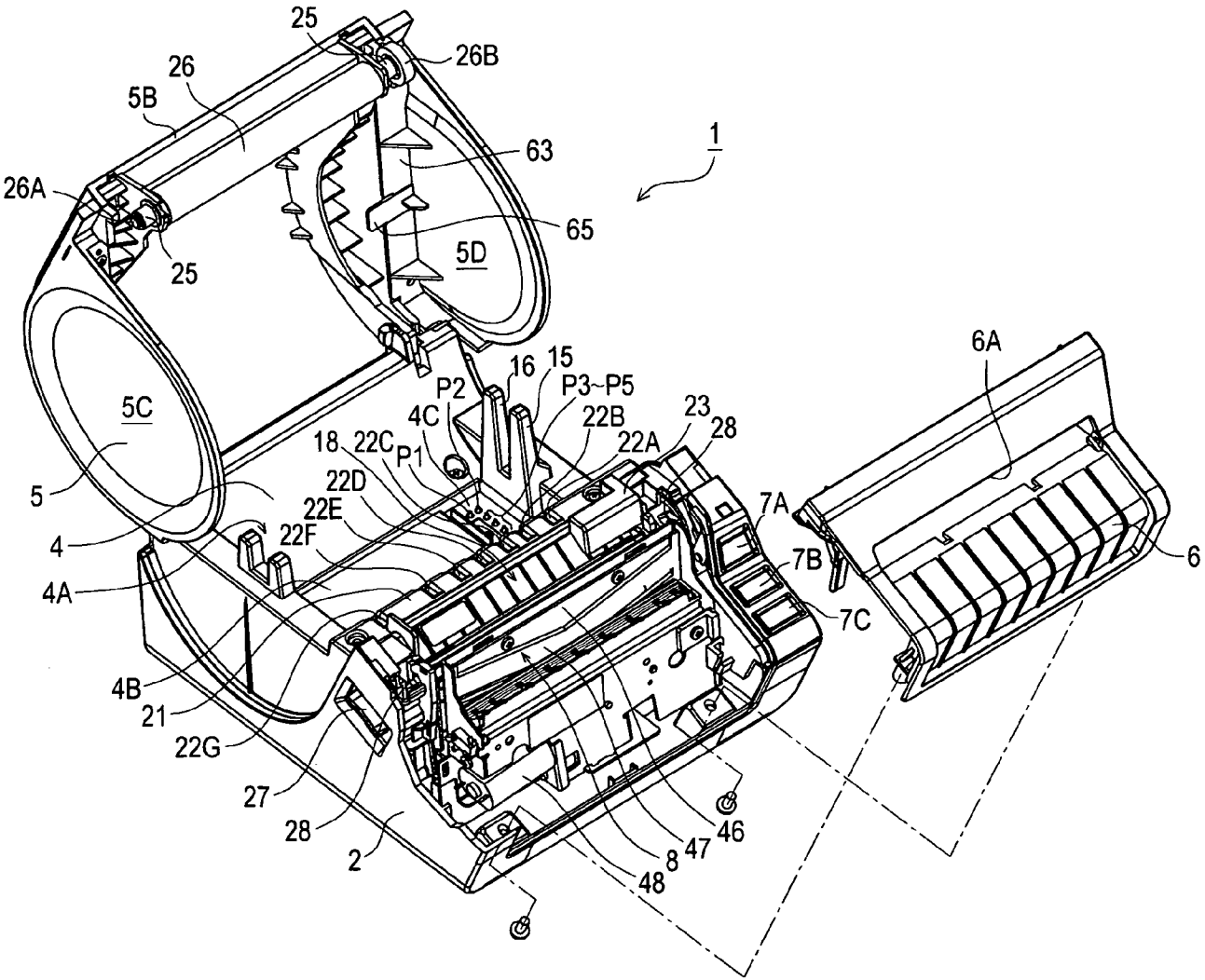
FIG. 6 is a perspective view of the tape-printing device, viewed from its upper-front side, with its upper cover being opened and its front cover being detached.

Furthermore, as shown in FIGS. 3, 4 and 6, the tape-printing device 1 is provided with a holder-supporting member 15 at a lateral end part (i.e., the right side end in FIG. 3,) of the rolled sheet holder storing part 4A, which is oriented approximately perpendicular to the sheet-feeding direction. The holder-supporting member 15 receives fittingly an approximately cross-sectionally rectangular mounting member 13, which projects outwardly from a positioning and retaining member 12 that constitutes the rolled sheet holder 3. The holder-supporting member 15 has a first positioning groove 16, which is approximately vertically long and U-shaped in front view and which opens upwardly widthwise on both sides.

In addition, the tape-printing device 1 is provided with a shouldering part 21, which extends approximately horizontally from the rear edge of an insertion slot 18, where the leading end of the rolled sheet 3A is inserted, to the upper-front edge of the rolled sheet holder storing part 4A. The shouldering part 21 supports the front end of a guide member 20, which constitutes the rolled sheet holder 3 described in detail below. In addition, the shouldering part 21 is provided at the corner of its rear edge in the feed direction with seven second positioning grooves 22A-22G, which are positioned in correspondence to a plurality of width dimensions applied variably for the rolled sheet 3A and are formed each in an approximately L-shaped cross-section. Each of the second positioning grooves 22A-22G is formed such that when the lower-front end of the guide member 20, which constitutes any rolled sheet holder 3 having a different width and comes into contact with the shouldering part 21, is lowered from above, and fits into a corresponding groove as shown in FIG. 5.

Furthermore, the rolled sheet holder storing part 4A is provided at its bottom with a positioning recess 4B, which is formed in a rectangle in plan view with a predetermined depth (about 1.5-3 mm in this embodiment) extending approximately perpendicular to the feed direction from the inward bottom end of the holder-supporting member 15 to the bottom end of the opposite side. The width of the positioning recess 4B in the feed direction is substantially equal to the width of the bottom end of the positioning and retaining member 12 and that of the guide member 20, which constitute the rolled sheet holder 3. In addition, near the inward bottom end of the holder-supporting member 15 in the positioning recess 4B, a discriminating recess 4C, which is deeper than the positioning recess 4B by a predetermined depth (about 1.5-3 mm in this embodiment), is provided in a rectangle in plan view elongated in the feed direction. The discriminating recess 4C is the part that faces a sheet-discriminating part 60 (refer to FIG. 7B), which extends inward from the lower end edge of the positioning and retaining member 12 at an approximately right angle. The sheet-discriminating part 60 will be described in detail later.

In the discriminating recess 4C, six sheet-discriminating sensors P1, P2, P3, P4, P5 and P6, each of which comprises a push-type microswitch, are provided in L-shaped alignment for discriminating, for example, the type of the rolled sheet 3A, the material of the heat-sensitive sheet 3C, and the width of the rolled sheet. FIG. 6 shows five of the sheet-discriminating sensors P1-P5.

Each sheet-discriminating sensor P1-P6 is a well-known mechanical switch, which comprises a plunger and a microswitch, and the upper part of each plunger extends from the bottom surface of the discriminating recess 4C to the vicinity of the bottom of the positioning recess 4B. As a result, when the rolled sheet holder 3 is loaded, and thereby the sheet-discriminating part 60, which extends inward from the lower end edge of the positioning and retaining member 12 at an approximately right angle, faces the sheet-discriminating sensors P1-P6, these sensors can discriminate the type of the rolled sheet 3A, the material of the heat-sensitive sheet 3C, and the width of the rolled sheet by the ON/OFF signals that are generated from the existence and nonexistence of sensory holes 60A-60F (refer to FIG. 7B), which are provided in the sheet-discriminating part 60. These sensory holes will be described later.

In this embodiment, the plunger of each sheet-discriminating sensor P1-P6 extends from the bottom surface of the discriminating recess 4C to the vicinity of the bottom of the positioning recess 4B in normal condition, so the microswitches are normally in OFF state. If the sensory holes 60A-60F exist in the sheet-discriminating part 60, which faces the sheet-discriminating sensors P1-P6, then the plungers are not pushed down, so the microswitches are kept in OFF state, generating OFF signals. On the other hand, if the sensory holes 60A-60F do not exist in the sheet-discriminating part 60, the plungers are pushed down, so the microswitches turn into ON state, generating ON signals. In this arrangement, the sheet-discriminating sensors P1-P6 together generate signals in 6 bits of "0" and "1". If all the sheet-discriminating sensors P1-P6 are in OFF state, i.e., if the rolled sheet holder 3 is not loaded, then 6 bit-signal "000000" is generated.

Furthermore, the lateral end (right-side edge in FIG. 3) of the insertion slot 18 toward the holder-supporting member 15 is provided on the same plane as the inward end of the positioning and retaining member 12, which fits into the holder-supporting member 15. In addition, at the lateral end of the insertion slot 18 toward the holder-supporting member 15, provided is a guide block 23 that comprises a guide wall portion vertically standing in the feed direction approximately to the rear end of the shouldering part 21 and a guide bar portion horizontally extending by a predetermined width for partially covering the upper surface of the rolled sheet 3A. Through the guide block 23, the extended part of the rolled sheet 3A is inserted.

In addition, a platen roller 26 is provided rotatably at the lower-front end of the upper cover 5, and a thermal head 31 is fixed on the upper surface of a head-supporting member 32, which is biased upward by a compression spring 24. The rear end in the feed direction of the head-supporting member 32 is supported vertically pivotally by the rear part of a frame 33. In addition, at the central front end in the feed direction of the head-supporting member 32, a guide part 34 extending outward by a predetermined width (about 15 mm in this embodiment) is provided fittingly in a guide hole 35, which is bored in the front part of the frame 33, such that the guide part 34 can be moved upward and downward.

When the upper cover 5 is closed, the platen roller 26 pushes the extended part of the rolled sheet 3A against the thermal head 31, which is biased upward by the compression spring 24, making the tape-printing device ready for printing operation. Also, when the upper cover 5 is closed, collar members 25 and 25, which are fitted rotatably around both ends of a roller shaft 26A of the platen roller 26, are engaged with engaging claws 28 and 28, each of which has a reversed shape of character "L" in side view and is biased rearward in the feed direction. At the end of the roller shaft 26A on the side of the holder-supporting member 15, a gear 26B is provided fixedly. Therefore, when the upper cover 5 is closed, the gear 26B meshes with a gear train (not shown), making the platen roller 26 rotatable by a sheet-feeding motor (not shown), which comprises, for example, a stepping motor.

The collar members 25 and 25 and the engaging nails 28 and 28 are disengaged when releasing release grips 27 and 27, which are provided in the right and left walls of the main body housing 2, are pushed upward to turn the engaging nails 28 and 28 frontward in the feed direction against the above mentioned rearward biasing force. When this action is taken, the platen roller 26 is pushed upward by the thermal head 31, so the upper cover 5 is lifted a little upward. Then, the upper cover 5 can be opened freely.

Furthermore, a control board 36 is provided under the rolled sheet holder storing case 4. The control board 36 comprises a control circuit unit that controls the actuation of each mechanism of the tape-printing device in response to the command entered from, for example, an external personal computer and carries the above mentioned sheet-discriminating sensors P1-P6 in alignment (refer to FIG. 8). In addition, a power board 37, which comprises a power supply circuit unit, is provided below the frame 33. The control board 36 and the power board 37 are protected by a bottom cover 38 made of a thin steel plate (for example, SPCC, with a thickness of about 0.5 mm in this embodiment), which is fixed by screws on the bottom of the housing.

Figure 7A:
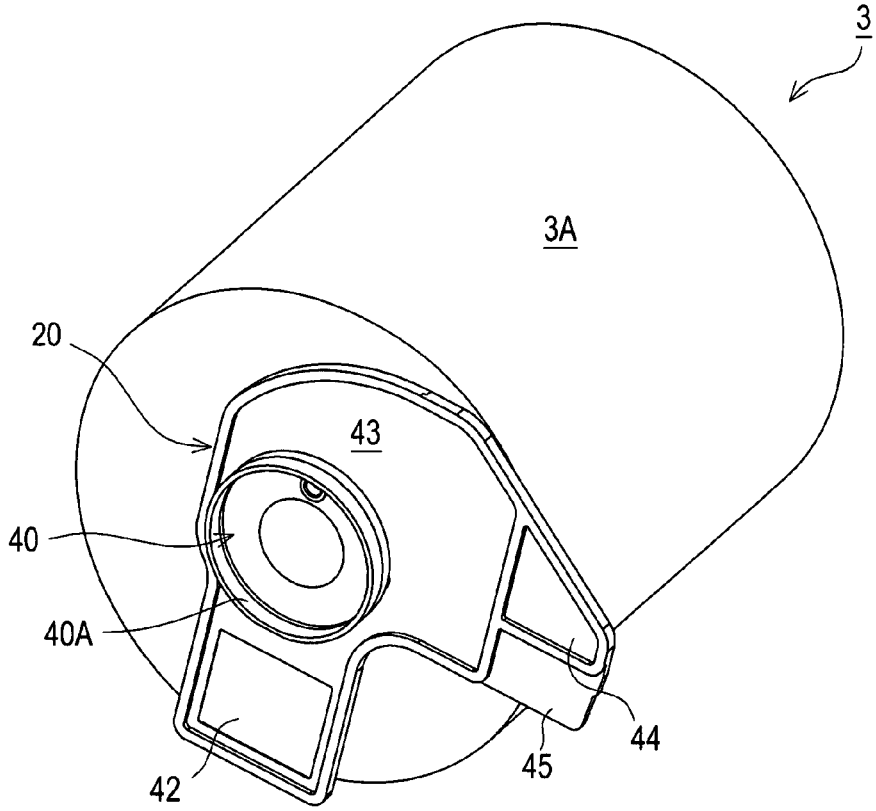
FIG. 7A is a perspective view of a rolled sheet holder, viewed from its upper side, which holder is presented as an example and carries a rolled sheet.
Figure 7B:
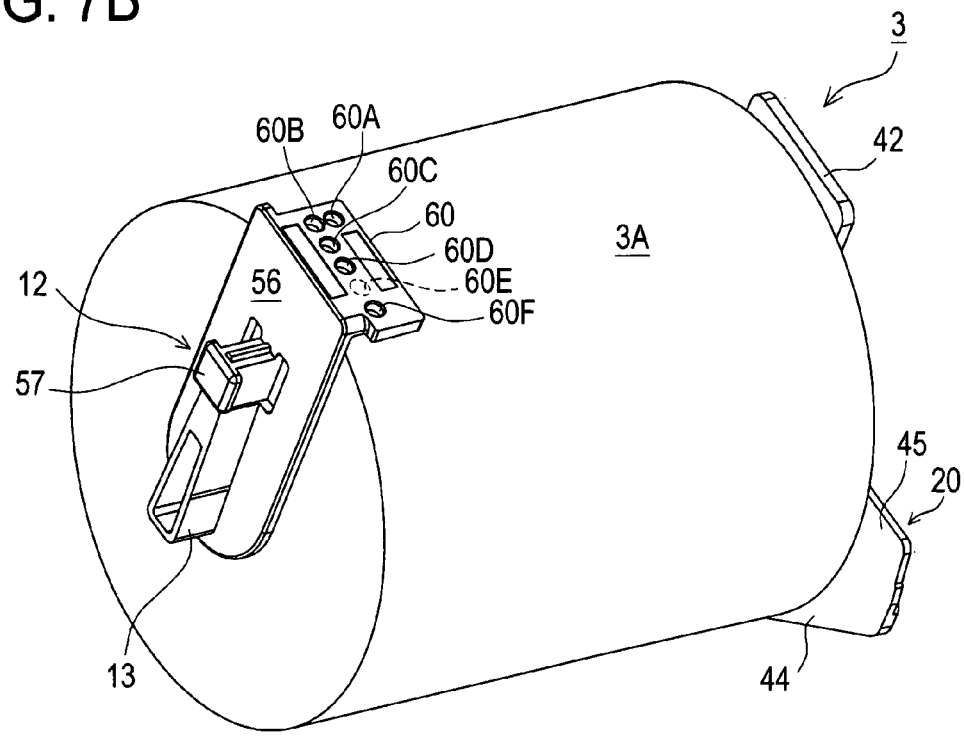
FIG. 7B is a perspective view of the rolled sheet holder, viewed from its lower side, which holder is loaded with the rolled sheet.
Figure 8:
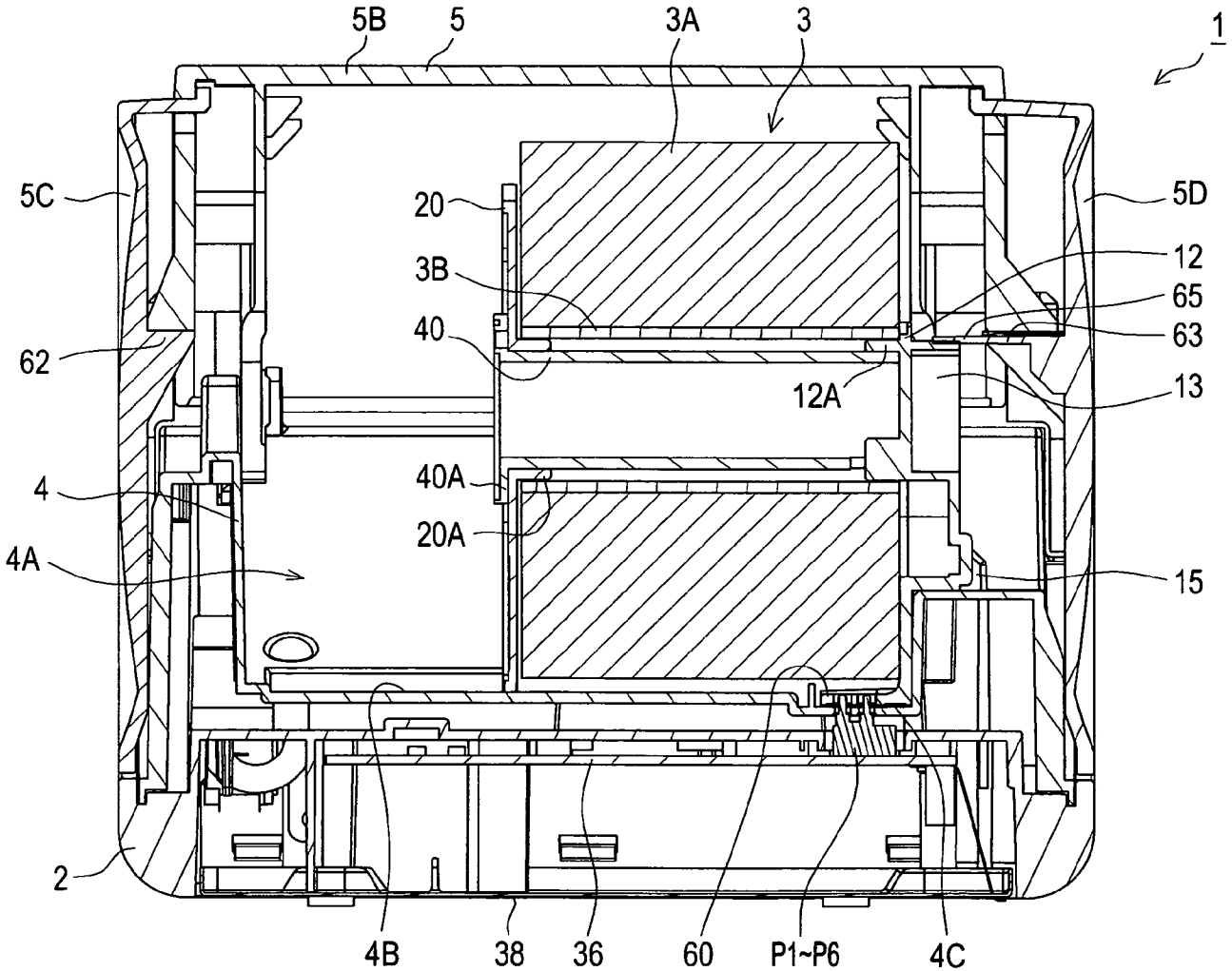
FIG. 8 is a cross-sectional view taken along line X1-X1 in FIG. 5.

Now, the construction of the rolled sheet holder 3 is described with reference to FIGS. 7A, 7B and 8. The rolled sheet holder 3 is to hold a rolled sheet 3A, which is rolled around a core tube 3B as shown in FIGS. 7A, 7B and 8, and it is constructed as follows. Into the left end of the cylindrical bore of the core tube 3B of the rolled sheet 3A, a first tubular part 20A that is provided upright on the inward surface of the guide member 20 is inserted fittingly, so that the inward surface of the guide member 20 comes into contact with the left end surface of the rolled sheet 3A. Also, into the right end of the cylindrical bore of the core tube 3B of the rolled sheet 3A, a second tubular part 12A that is provided upright on the inward surface of the positioning and retaining member 12 is inserted fittingly, so that the inward surface of the positioning and retaining member 12 comes into contact with the right end surface of the rolled sheet 3A. Then, into the first tubular part 20A of the guide member 20 and into the second tubular part 12A of the positioning and retaining member 12, an approximately tubular holder-shaft member 40 having a radially outward flange part 40A at the left end thereof is inserted such that the right end of the holder-shaft member 40 fits loosely into the second tubular part 12A of the positioning and retaining member 12 fixedly, between the flange part 40A and the outward end of the first tubular part 20A, i.e., the outward end of the guide member 20. Because the rolled sheet holder 3 has this design, a plurality of types of rolled sheet holders for rolled sheets 3A of different widths can be easily manufactured only by changing the length of the holder-shaft member 40.

The guide member 20 comprises a first extended portion 42, a second extended portion 43 and a third extended portion 44. The first extended portion 42 extends downward from the lower peripheral part of the outward end of the first tubular part 20A, so when the first extended portion 42 is inserted into the positioning recess 4B, which is provided at the bottom of the rolled sheet holder storing part 4A, it comes into contact with the bottom surface of the positioning recess 4B. The second extended portion 43 extends outward so as to cover a quarter of the circumference of the rolled sheet 3A at the front end thereof, and the third extended portion 44 extends downward with its upper edge from the peripheral part of the second extended portion 43 to the shouldering part 21. The lower end of the third extended portion 44 is substantially horizontal, and the lower front part 45 thereof is so designed that it fits into a corresponding one of the second positioning grooves 22A-22G, which are provided in correspondence to the sheet width of the loaded rolled sheet 3A (refer to FIGS. 3 and 4). The inward surface of the third extended portion 44 is intended to guide the edge of the rolled sheet 3A being fed into the insertion slot 18 (refer to FIG. 4).

The core tube 3B of the rolled sheet 3A is retained rotatably between the first tubular part 20A, which is provided upright on the inward surface of the guide member 20, and the second tubular part 12A, which is provided upright on the inward surface of the positioning and retaining member 12. A plurality of holder-shaft members 40 having different lengths are prepared each in correspondence to the length of the core tube 3B of the rolled sheet 3A (seven different holder-shaft members are prepared in this embodiment).

Furthermore, a vertically long mounting member 13 having a rectangular cross-section is provided protruding approximately at the center in the feed direction of the outward end of the positioning and retaining member 12, i.e., perpendicular to the end part of the axis of the holder-shaft member 40. The mounting member 13 has a shape whose width becomes narrower downward (upward in FIG. 7B) in front view, so it can fit into the downwardly narrowing first positioning groove 16 of the holder-supporting member 15 of the tape-printing device 1. Therefore, the protrusion of the mounting member 13 has a height that is substantially equal to the width of the first positioning groove 16.

Moreover, a guide portion 57 is provided at the lower end of the mounting member 13 of the positioning and retaining member 12. The guide portion 57 extends outwardly to the right and to the left by a predetermined length (by about 1.5 mm-3 mm in this embodiment) from the lower end of the mounting member 13 and has an approximately rectangular shape in front view like a flat plate (with a thickness of about 1.5 mm-3 mm in this embodiment). With this provision, when the rolled sheet holder 3 is loaded, the guide portion 57, which is provided at the lower end of the mounting member 13, comes into contact with the outward end surface of the holder-supporting member 15, so that the rolled sheet holder 3 is easily and correctly positioned before the mounting member 13 is inserted into the first positioning groove 16 for setting up the rolled sheet holder 3.

The lower end of the extended portion 56 of the positioning and retaining member 12 protrudes downward beyond the lower end of the guide member 20 by a predetermined length (about 1 mm-2.5 mm in this embodiment), and at the lower end of the extended portion 56, the above mentioned rectangular sheet-discriminating part 60 is provided extending inwardly by a predetermined length substantially at a right angle.

As shown in FIG. 7B, the sheet-discriminating part 60 includes the sensory holes 60A-60F arranged in the L-shaped alignment, which correspond positionally to the sheet-discriminating sensors P1-P6, as described above. FIG. 7B shows a condition where only sensory holes 60A-60D and 60F of the sensory holes 60A-60F are provided in the sheet-discriminating part 60.

Because a maximum of five holes are provided as the sensory holes 60A-60F, with the existence of a hole being represented by "1" and the nonexistence of a hole being represented by "0", the type, the material of the heat-sensitive sheet, the width and the like of the rolled sheet 3A, which is set in the rolled sheet holder 3, are represented by a code comprising 6 bits from "000001" to "111111". Code "000000" is reserved for expressing that no rolled sheet holder 3 is loaded.

Now, a holder retainer, which is provided to the upper cover 5 for retaining the rolled sheet holder 3, is described with reference to FIGS. 3, 4, 6 and 8. As shown in FIGS. 3, 4 and 8, the upper cover 5 comprises an upper cover main body 5B, and approximately circular left and right cover members 5C and 5D, which are fixed on the upper cover main body 5B, for example, by screws.

Furthermore, reinforcement ribs 62 and 63 are provided upright and horizontally all across on the inward surfaces of the left and right cover members 5C and 5D, respectively, so that when the upper cover 5 is closed, the reinforcement ribs 62 and 63 come to face the upper end of the mounting member 13 of the rolled sheet holder 3, which is loaded in the rolled sheet holder storing part 4A.

The above mentioned holder retainer 65 is provided extending inwardly and horizontally at the position of the reinforcement rib 63, which is provided upright on the inward surface of the right cover member 5D, where the upper end of the mounting member 13 comes to face. The holder retainer 65 is a thin flat plate (about 1 mm thick in this embodiment) having a predetermined width (about 12 mm, which is about 1.5 times the width of the mounting member 13 in this embodiment). The holder retainer 65 extends inwardly so that the lower front end of the holder retainer 65 comes into contact with the upper end of the mounting member 13 but never comes into contact with the positioning and retaining member 12 when the upper cover 5 is closed.

With the above described arrangement, the rolled sheet holder 3, in which the rolled sheet 3A rolled around the core tube is loaded, is removably mounted in the rolled sheet holder storing part 4A by fitting the mounting member 13 of the positioning and retaining member 12 into the first positioning groove 16 of the holder-supporting member 15, by fitting the lower front end of the guide member 20 into a corresponding one of the second positioning grooves 22A-22G, and by mating the lower end of the guide member 20 fittingly with the positioning recess 4B. After the sheet-discriminating part 60, which is provided at the inwardly lower end of the positioning and retaining member 12, is inserted into the discriminating recess 4C, it is possible to detect the existence and nonexistence of the sensory holes 60A-60F of the sheet-discriminating part 60, which faces the sheet-discriminating sensors P1-P6 provided in the discriminating recess 4C. In other words, the tape-printing device is ready for detecting the type of the rolled sheet 3A, which has been just loaded.

Now, while the left edge of the rolled sheet 3A is kept in contact with the inside of the guide member 20, the right edge thereof is brought into contact with the guide block 23, which is provided at the right end of the insertion slot 18. Then, the leading end of the rolled sheet 3A is put through the insertion slot 18, and the upper cover 5 is closed. As a result, the leading part of the rolled sheet 3A is pressed against the line-type thermal head 31, which is biased upward by the compression spring 24, making the tape-printing device 1 ready for printing as shown in FIG. 5. In this condition, with the upper cover 5 being closed, the lower surface of the holder retainer 65, which is provided extending inside the right cover member 5D, is in contact with the upper end of the mounting member 13, pushing the positioning and retaining member 12 of the rolled sheet holder 3 downward as shown in FIG. 8.

While the above mentioned platen roller 26 is being rotated by the sheet-feeding motor (not shown), which comprises, for example, a stepping motor, the operation of the thermal head 31 is controlled to print, for example, an image sequentially on the print surface of the heat-sensitive sheet 3C by feeding the rolled sheet 3A. After the printing, the printed part of the rolled sheet 3A is cut off by the above mentioned cutter unit 8, which comprises a fixed blade 46 and a mobile blade 47 in a V-shape in front view. Specifically, when the rear end in the feed direction of the printed part reaches where the fixed blade 46 is located, the mobile blade 47 is reciprocated vertically by a cutting motor 48 (refer to FIG. 6), which comprises, for example, a DC motor. This cut-off piece, i.e., the printed sheet is then discharged from a sheet outlet 6A.

The tape-printing device 1, which is described above, includes hinges 29 and 30 and hinge pins 29A and 30A that connect pivotally the upper rear edge of the rolled sheet holder storing case 4 made of a plastic and the lower rear edge of the upper cover 5 also made of a plastic, so that the upper cover 5 is freely openable. Now, how these hinges are constructed and how hinge pins 29A and 30A are engaged are described with reference to FIG. 9.

As shown in FIG. 9, the rear wall 2A of the main body housing 2 is provided with the above mentioned power inlet 9 at the right end in the drawing and with the blower fan 17 immediately beside the power inlet 9. As mentioned above, the USB (Universal Serial Bus) connector 10, which is used for connection, for example, to a personal computer (not shown), and another connector 11 are provided near the left end of the rear wall. In addition, the rolled sheet holder storing case 4 is attached to the main body housing 2, and a fixed hinge rib 29D, which constitutes the hinge 29, is provided as a unified part at the end of the rolled sheet holder storing case 4 above the power inlet 9. In parallel with the fixed hinge rib 29D, another fixed hinge rib 29F, which also constitutes the hinge 29, is provided outwardly. The fixed hinge rib 29D has a through-hole 29E, where a hinge pin 29A is inserted outwardly from inside, and the outwardly positioned fixed hinge rib 29F has another smaller through-hole 29G that allows insertion of only the thinned part 29B provided at only one end of the hinge pin 29A. On the other hand, another fixed hinge rib 30D, which constitutes the hinge 30, is provided as a unified part at the end of the rolled sheet holder storing case 4 above the USB connector 10, and another fixed hinge rib 30F, which also constitutes the hinge 30, is provided outwardly in parallel with the fixed hinge rib 30D. The fixed hinge rib 30D has a through-hole 30E, where a hinge pin 30A is inserted outwardly from inside, and the outwardly positioned fixed hinge rib 30F has another smaller through-hole 30G that allows insertion of only the thinned part 30B provided at only one end of the hinge pin 30A.

Correspondingly, the upper cover 5 made of a plastic is provided with right and left rotatable hinge ribs 29H and 30H as unified parts, respectively, at the lower rear edge thereof. One rotatable hinge rib 29H, which constitutes the hinge 29, has a through-hole 29J that allows insertion of the hinge pin 29A and is to be placed between the positionally corresponding fixed hinge ribs 29D and 29F. Also, the other rotatable hinge rib 30H, which constitutes the hinge 30, has a through-hole 30J that allows insertion of the hinge pin 30A and is to be placed between the positionally corresponding fixed hinge ribs 30D and 30F.

For connecting pivotally the upper rear edge of the rolled sheet holder storing case 4 and the lower rear edge of the upper cover 5 so that the upper cover 5 is freely openable, at first, the upper cover 5 is oriented and brought in the direction indicated by arrow A. Then, the rotatable hinge ribs 29H and 30H of the upper cover 5 are placed, respectively, between the positionally corresponding fixed hinge ribs 29D and 29F and between the other positionally corresponding fixed hinge ribs 30D and 30F of the rolled sheet holder storing case 4.

Now, one hinge pin 29A is inserted with its thinned part 29B as leading head, firstly into the through-hole 29E of the inwardly located fixed hinge rib 29D, secondly into the through-hole 29J of the rotatable hinge rib 29H, and finally into the through-hole 29G of the outwardly located fixed hinge rib 29F and pushed until the shoulder of the hinge pin 29A toward the thinned part 29B hits the outwardly positioned fixed hinge rib 29F, stopping the further insertion of the hinge pin 29A. In the same manner, the other hinge pin 30A is inserted with its thinned part 30B as leading head, firstly into the through-hole 30E of the inwardly located fixed hinge rib 30D, secondly into the through-hole 30J of the rotatable hinge rib 30H, and finally into the through-hole 30G of the outwardly located fixed hinge rib 30F and pushed until the shoulder of the hinge pin 30A toward the thinned part 30B hits the outwardly positioned fixed hinge rib 30F, stopping the further insertion of the hinge pin 30A. As a result of this procedure, the upper cover 5 is attached pivotally to the rolled sheet holder storing case 4 by the hinges 29 and 30.

However, at this point, the hinge pins 29A and 30A are not fixed yet. How these pins are fixed is described in the following. As shown in FIG. 9, the main body housing 2 is provided in the rear wall 2A thereof with an engaging slot 2E, which is located close to the left side of the fixed hinge rib 30F, another engaging slot 2F below the USB connector 10, another engaging slot 2G below the another connector 11, another engaging slot 2H below the power inlet 9, and another engaging slot 2J close to the right side of the fixed hinge rib 29F. In correspondence to these engaging slots, the rear cover 14 is provided with an engaging nail 14A, which is to mate with the engaging slot 2E, another engaging nail 14B to mate with the engaging slot 2F, another engaging nail 14C to mate with the engaging slot 2G, another engaging nail 14D to mate with the engaging slot 2H, and another engaging nail 14E to mate with the engaging slot 2J. Additionally, the rear cover 14 is provided with stopper ribs 14F and 14G at predetermined positions, so that the stopper ribs 14F and 14G come to face the pin-end surfaces 29C and 30C of the hinge pins 29A and 30A, respectively, which have been inserted and are in position, when the rear cover 14 is attached. For achieving these corresponding positional relations, the rear cover 14 is oriented and pushed in the direction indicated by arrow B, so that the rear cover 14 is attached on the rear wall 2A of the main body housing 2. In the attached condition, the stopper ribs 14F and 14G are in contact with the pin-end surfaces 29C and 30C of the hinge pins 29A and 30A, respectively, preventing the hinge pins 29A and 30A from coming out.

After the upper cover 5 has been attached, if the upper cover 5 is closed, the holder retainer 65, which extends inwardly on the right cover member 5D attached on the upper cover 5, comes into contact with and retains the rolled sheet holder 3. Then, the sheet-discriminating sensors P1-P6, which are provided in the discriminating recess 4C (refer to FIG. 8), detects, for example, the type of the rolled sheet 3A set in the rolled sheet holder 3. For the sheet-discriminating sensors P1-P6 to function correctly, it is necessary to ensure that the upper cover 5 be shut completely. Also, the front cover 6 must be attached in correct position with respect to the cutter unit 8 if it has been removed for cleaning or repair work. It is important both for safety, i.e., for preventing any finger-involving injury and for reliability, i.e., for ensuring that the printed part of the rolled sheet 3A after being cut off by the cutter unit 8 be discharged through the sheet outlet 6A.

For these reasons, in this embodiment, a detection system is arranged for detecting the complete closure of the upper cover 5 and the positionally correct attachment of the front cover 6. In this system, the action closing the upper cover 5 to the rolled sheet holder storing case 4 is relayed to an actuator 51 provided on the front cover 6, which is described later, and then, the action relayed to the actuator 51 is detected by a mechanical switch 52, which comprises a detection sensor described later. Therefore, the arrangement of this system and the actions relayed are now described with reference to FIGS. 10-15.

Figure 10:
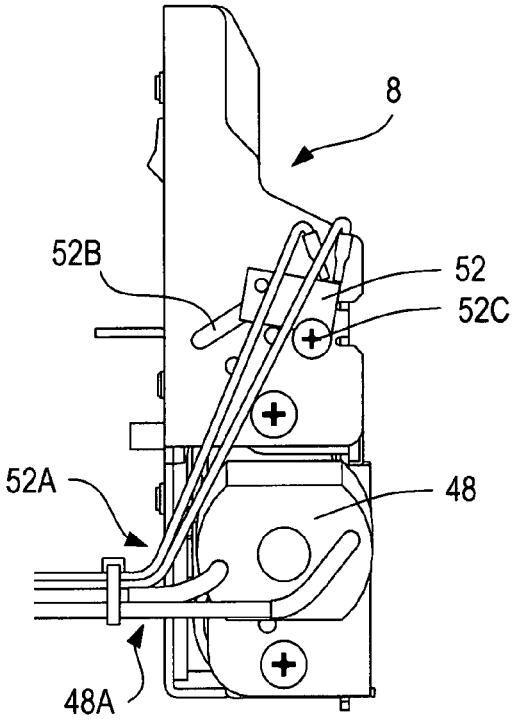
FIG. 10 is a left side view of a cutter unit, showing a mechanical switch, which is provided to the cutter unit.

At first, a description is given with reference to FIG. 10. A mechanical switch 52, which comprises a switch lever 52B, is fixed on a side of the cutter unit 8 by a screw 52C as shown in FIG. 10, and lead wires 52A from the mechanical switch 52 are connected to the control board 36 (refer to FIG. 5). Also, lead wires 48A pulled out from a cutting motor 48, which is provided below the cutter unit 8, are connected to the control board 36.

Figure 11:
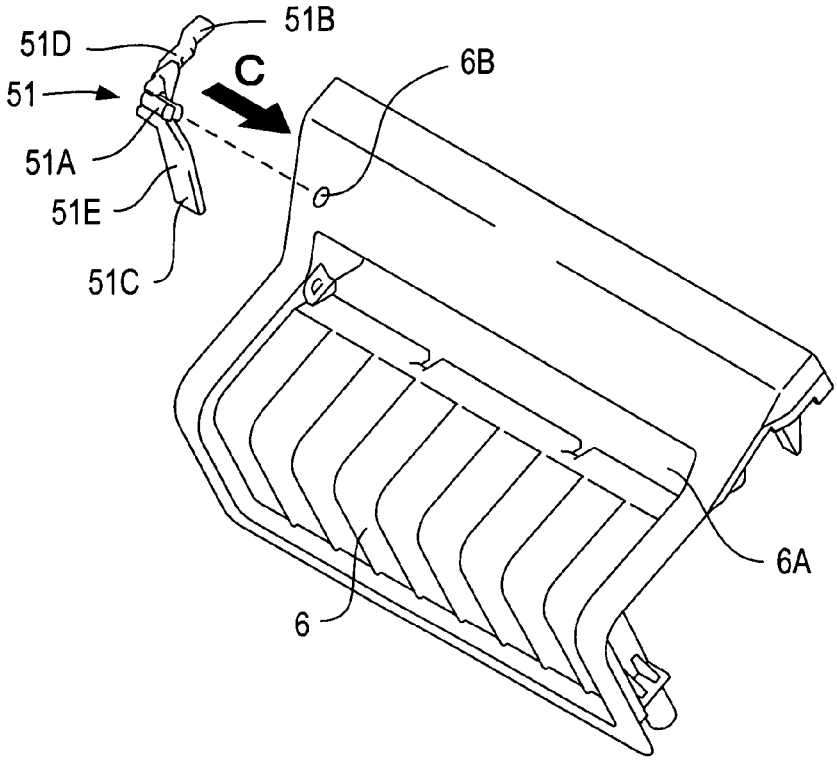
FIG. 11 is an illustration showing an actuator being attached to the front cover.

As shown in FIG. 11, the front cover 6, which has a sheet outlet 6A and covers the cutter unit 8, is provided on the right side thereof (on the right side in FIG. 11) with a rotatably engaging bore 6B, which engages with a rotatably engaging pin 51A provided to the above mentioned actuator 51. The rotatably engaging pin 51A, whose engaging part has a form of split pin, is inserted in the direction indicated by arrow C and then rotatably fixed to the rotatably engaging bore 6B. As a result, the actuator 51, which comprises two extended portions 51D and 51E formed radially from the rotatably engaging pin 51A, is positionally fixed but rotatable and functions to convey the lowering motion of the upper cover 5 to the mechanical switch 52. Therefore, the actuator 51 further comprises a load-receiving part 51B (the upper part of the actuator 51 in the FIG. 11), which is located at the end of one extended portion 51D, and a switch-actuating part 51C (the lower part of the actuator 51 in the FIG. 11), which is located at the end of the other extended portion 51E.

Figure 12:
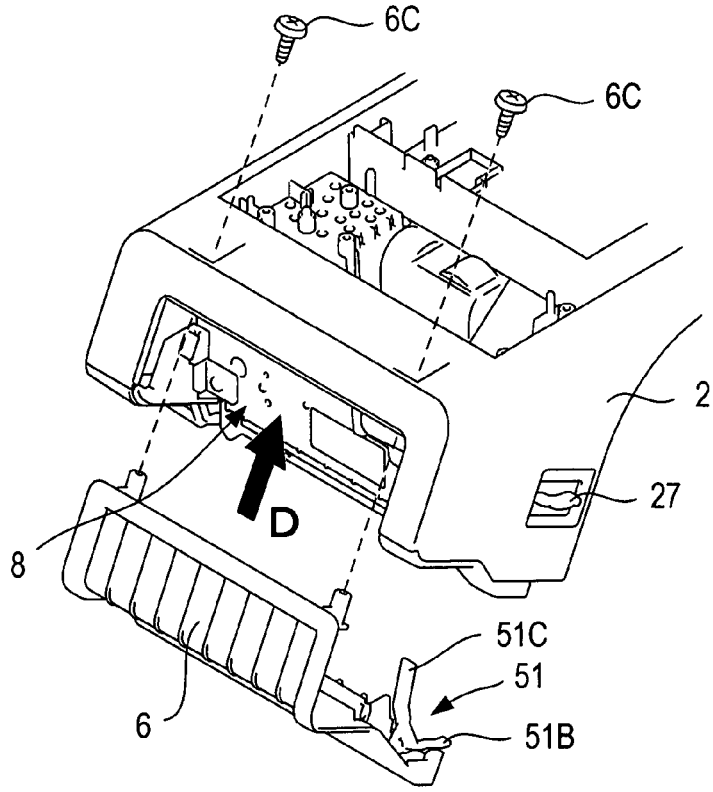
FIG. 12 is an illustration showing the cutter unit being attached to the main body housing and the front cover being fixed by screws, which extend through the main body housing.
Figure 13:
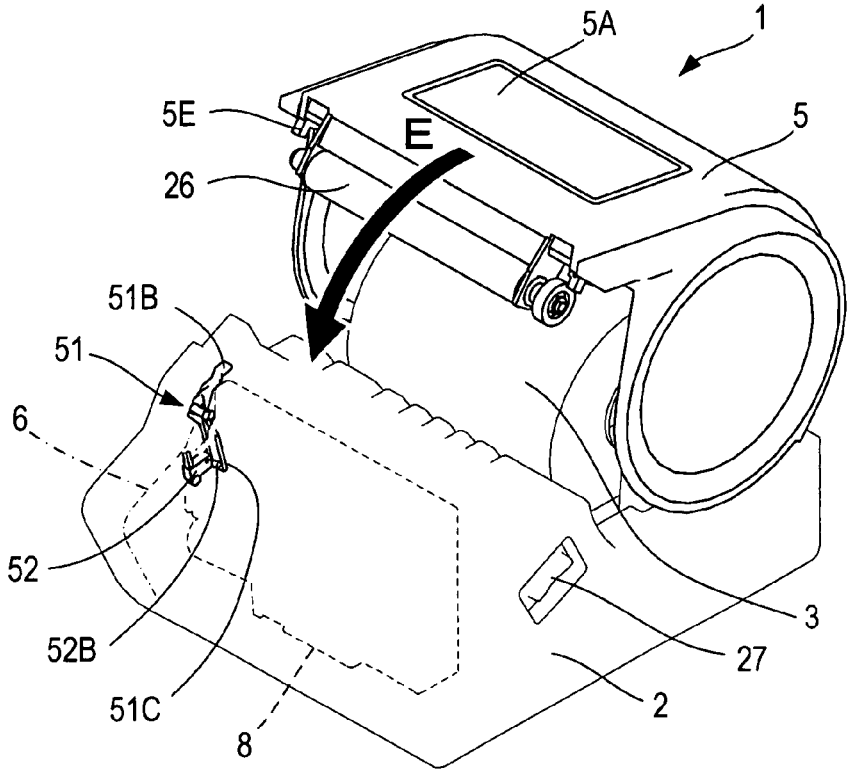
FIG. 13 is a perspective view for describing positional relations between an actuator-lowering protrusion, which is provided to the upper cover, an actuator, and a mechanical switch while the upper cover is being closed in the tape-printing device.

As shown in FIG. 12, after the cutter unit 8 is attached into the main body housing 2, the front cover 6, to which the actuator 51 is engaged, is oriented with respect to and attached to the main body housing 2 in the direction indicated by arrow D, so that the front cover 6 covers the cutter unit 8. Then, it is fixed by screws 6C and 6C.

Furthermore, the upper cover 5 is provided with an actuator-lowering protrusion 5E, which conveys the opening and closing motion of the upper cover 5 to the load-receiving part 51B of the actuator 51. Therefore, it is important to keep the positional relations of the actuator-lowering protrusion 5E, the actuator 51 and the mechanical switch 52, which are described with reference to FIG. 13.

The actuator-lowering protrusion 5E is located on the front left side of the upper cover 5 and outward from the platen roller 26. When the upper cover 5 is closed in the direction indicated by arrow E, the actuator-lowering protrusion 5E comes into contact with and pushes the load-receiving part 51B of the actuator 51, which is located on the left side of the front cover 6. The pushing force of the actuator-lowering protrusion 5E acting on the load-receiving part 51B of the actuator 51 turns the actuator 51, and the switch-actuating part 51C of the actuator 51, in turn, pushes the switch lever 52B of the mechanical switch 52, which is located on the left side of the cutter unit 8. By the way, after this system or mechanism is assembled, some adjustments are made for achieving the correct positional relations between the actuator-lowering protrusion 5E of the upper cover 5, the actuator 51 and the mechanical switch 52, so that the intended function is ensured. Actually, adjustments are made to the lengths and the angles of the extended portions 51D and 51E, which extend to the load-receiving part 51B and to the switch-actuating part 51C, respectively, from the centrally located rotatably engaging pin 51A of the actuator 51.

Figure 14:
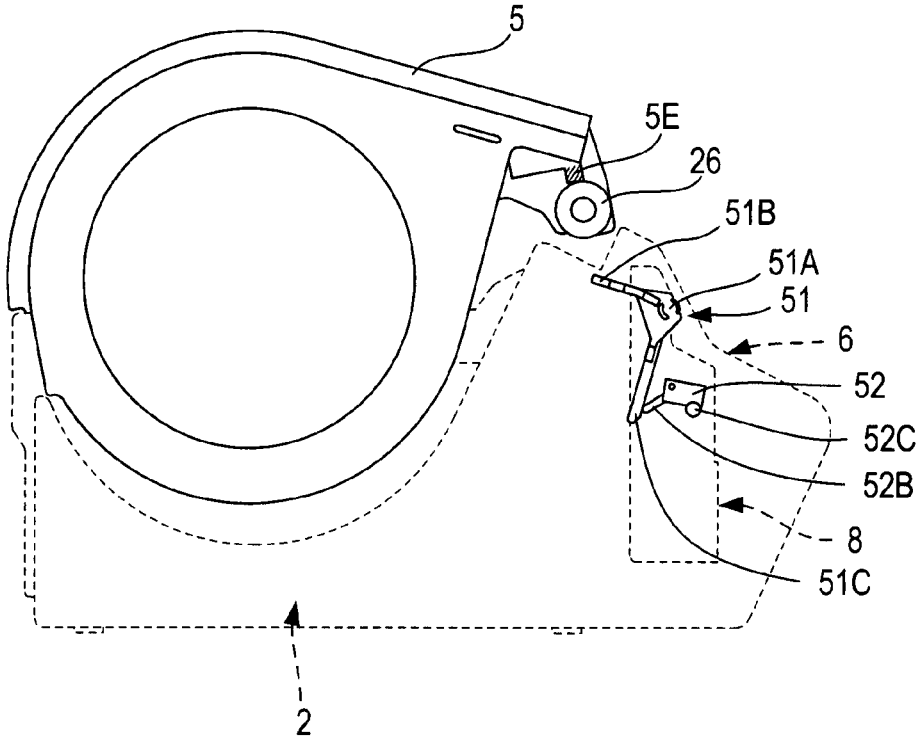
FIG. 14 is a through-view for describing positional relations between the actuator-lowering protrusion of the upper cover, the actuator, and the mechanical switch in the tape-printing device.

Now, the actions of the actuator-lowering protrusion 5E of the upper cover 5, the actuator 51 and the mechanical switch 52, respectively, are described with reference to FIGS. 14 and 15.

In the condition shown in FIG. 14, where the upper cover 5 is not closed completely, the actuator-lowering protrusion 5E, which is located above the platen roller 26 in side view, does not have any influence both on the actuator 51 and on the mechanical switch 52, which are located below the actuator-lowering protrusion 5E. By design, when an appropriate pushing force is applied on the switch lever 52B of the mechanical switch 52, the switch lever 52B pivots to turn the switch ON. On the other hand, if the force is eliminated, the switch lever 52B returns to its original position by the action of an elastic member (not shown) incorporated in the switch. Because a force necessary for the activation of the mechanical switch 52 is not acting on the switch lever 52B in the condition shown in FIG. 14, the switch lever 52B is in its original position by the elastic member (not shown). In this condition, the switch-actuating part 51C of the actuator 51, which is in contact with the switch lever 52B, assumes such an angular position that results in the load-receiving part 51B, which is oppositely located around the rotatably engaging pin 51A, to take its rotational uppermost position. This resultant condition lasts as long as the upper cover 5 is not closed completely.

Figure 15:
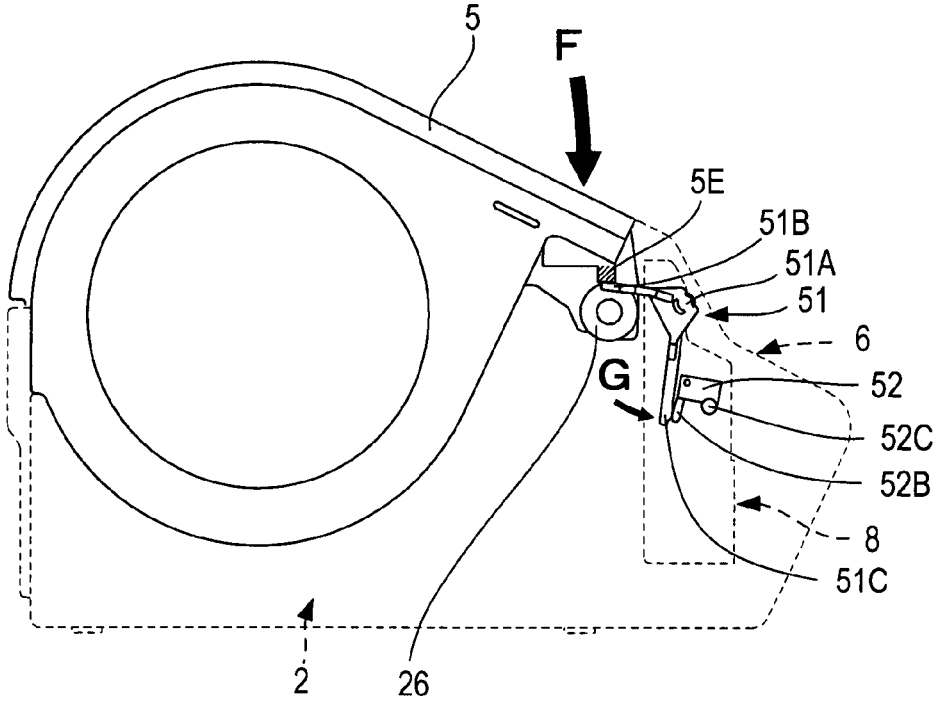
FIG. 15 is a through-view for describing the order of actions taken by the actuator-lowering protrusion of the upper cover, the actuator and the mechanical switch while the upper cover is being closed in the tape-printing device.

From this condition, if the upper cover 5 is pushed down in the direction indicated by arrow F as shown in FIG. 15, the actuator-lowering protrusion 5E of the upper cover 5 comes into contact with the load-receiving part 51B of the actuator 51 and pushes down the load-receiving part 51B. As a result, the actuator 51, which is attached on the front cover 6, pivots around the rotatably engaging pin 51A. This means that the switch-actuating part 51C, which is positioned opposite to the load-receiving part 51B around the rotatably engaging pin 51A, pushes the switch lever 52B of the mechanical switch 52, which is attached on the cutter unit 8, in the direction indicated by arrow G. As a result, when the upper cover 5 is closed completely, the mechanical switch 52 is turned ON.

In this way, the action for closing the upper cover 5 to the rolled sheet holder storing case 4 is relayed to the actuator 51, which is provided on the front cover 6, and the action taken by the actuator 51 is detected by the mechanical switch 52, which is attached on the cutter unit 8. This sequentially detecting system, which comprises the mechanical switch 52 and the actuator 51, is simple in construction, but it ensures safety because it prevents the device from operating if even one of the elements constituting the system is missing.

Here, the rolled sheet holder storing case 4 represents a first cover body; the upper cover 5, a second cover body; the front cover 6, a third cover body; the actuator 51, an actuating member; the mechanical switch 52, the detecting means; and the tape-printing device, an electronic device.

As described above in detail, the tape-printing device 1 comprises the upper cover 5, the front cover 6, the actuator 51, and the mechanical switch 52. The upper cover 5 can be opened or closed with respect to the rolled sheet holder storing case 4, and the front cover 6 is removably attached on the rolled sheet holder storing case 4 for covering the cutter unit 8 provided in the rolled sheet holder storing case 4. The actuator 51 is provided on the front cover 6 and makes an action when the upper cover 5 is closed to the rolled sheet holder storing case 4, and the mechanical switch 52 detects the action of the actuator 51. In the tape-printing device 1, the system for detecting sequentially the action taken for closing the upper cover 5 to the rolled sheet holder storing case 4 comprises the actuator 51, which is provided on the front cover 6 and to which the action is relayed, and the mechanical switch 52, which detects the action relayed to the actuator 51. This system is a so-called fool-proof design. For example, if the front cover 6 is not attached correctly by a repairer after some repair work is done or if the actuator 51 breaks down, then the system loses its structural integrity or continuity so that the tape-printing device 1 ceases to operate, especially preventing the cutter unit 8 from being activated unexpectedly. This system is also a cost-effective design because one mechanical switch 52 is used for detecting the open/close condition and attached condition of a plurality of covers, i.e., the upper cover 5 and the front cover 6.

Because the mechanical switch 52 is positioned on the cutter unit 8, which is stored in the rolled sheet holder storing case 4, the correct positioning of the mechanical switch 52 with respect to the actuator 51 is not affected even by the repeated detachment and attachment of the front cover 6, which is removably provided on the rolled sheet holder storing case 4 for covering the cutter unit 8 stored in the rolled sheet holder storing case 4.

The application of the mechanical switch 52 for detecting the action of the actuator 51 makes clear the position of the switching ON/OFF, and thereby avoids such a vague detection range as experienced with an optical switch or a magnet switch. As a result, this system design ensures that the closing of the upper cover 5 to the rolled sheet holder storing case 4 be detected accurately by relaying the closing action to the actuator 51, which is provided on the front cover 6, and by detecting the action of the actuator 51 by the mechanical switch 52.

As described above, the actuator 51 comprises the rotatably engaging pin 51A, and the two extended portions 51D and 51E, which extend from the rotatably engaging pin 51A. When the load-receiving part 51B, which is provided to one extended portion 51D, is pushed down by the actuator-lowering protrusion 5E, which is provided on the upper cover 5, the switch-actuating part 51C, which is provided to the other extended portion 51E, now pivoting around the rotatably engaging pin 51A, pushes the mechanical switch 52. This arrangement is simple in construction and can be manufactured in a cost-effective way. It is also relatively easy to adjust the stroke that effects the ON/OFF of the mechanical switch 52.

In addition, the actuator 51 is provided on a side of the front cover 6 without any interference to the front of the path for feeding sheet from the rolled sheet 3A. As a result, this arrangement provides freedom in designing the feeding path.

The upper cover 5 is provided such that it can open or close pivotally with respect to the rolled sheet holder storing case 4, and it is provided with the actuator-lowering protrusion 5E, which pushes down the load-receiving part 51B of the actuator 51, at the end of the upper cover 5 away from the pivotal axis. As a result, the distance over which the actuator-lowering protrusion 5E reciprocates is relatively large. This condition makes it easier to adjust the protrusion of the actuator-lowering protrusion 5E and the length of the extended portion 51D of the actuator 51 for ensuring the turning ON and OFF of the mechanical switch 52, and it also increases the degree of freedom in designing the tape-printing device 1.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. An electronic device comprising:

a first cover body, which constitutes a housing for the device and houses a component inside;

a second cover body, which is provided openable and closable with respect to the first cover body;

a third cover body, which is provided removably to the first cover body, for covering the component housed in the first cover body;

an actuating member, which is provided on the third cover body and makes an action when the second cover body is closed to the first cover body; and detecting means, which detects the action of the actuating member.

2. The electronic device according to claim 1, wherein if the detecting means does not detect the action of the actuating member, then the electronic device is not set in operation.

3. The electronic device according to claim 1, wherein the detecting means, which detects both the opening or closing action of the second cover body and the action of the actuating member, comprises only one detecting means.

4. The electronic device according to claim 1, wherein the detecting means is attached on the component, which is housed in the first cover body.

5. The electronic device according to claim 1, wherein the detecting means comprises a mechanical switch.

6. The electronic device according to claim 1, wherein:

the actuating member is an actuator that comprises a rotational center and two extended portions, each of which extends from the rotational center; and when one end of the actuator is pushed down by the second cover body, another end of the actuator being pivoted around the rotational center actuates the detecting means to perform the detection.

7. The electronic device according to claim 1, wherein the actuating member is attached on a side of the third cover body.

8. The electronic device according to claim 1, wherein:

the second cover body is provided with a pivotal axis such that it can be opened and closed pivotally with respect to the first cover body; and at an end of the second cover body distant from the pivotal axis, the second cover body is provided with a pushing part, which pushes the one end of the actuating member.

* * * * *